United States Patent [19]

McElroy

[11] 3,936,033

[45] Feb. 3, 1976

[54] HAND WINCH

[75] Inventor: Robert C. McElroy, Lisbon, Ohio

[73] Assignee: Cable Climber Safety Devices Incorporated, Lisbon, Ohio

[22] Filed: Aug. 19, 1974

[21] Appl. No.: 498,519

[52] U.S. Cl. ..... 254/186 HC

[51] Int. Cl.[2] ..... B66D 1/04

[58] Field of Search ..... 254/150 R, 186 R, 186 HC

[56] References Cited

UNITED STATES PATENTS

| | | | |
|---|---|---|---|
| 1,579,483 | 4/1926 | Joyce | 254/186 HC |
| 2,417,199 | 3/1947 | Hite | 254/186 HC |
| 3,799,005 | 3/1974 | Koehler | 254/150 R X |

*Primary Examiner*—Robert G. Sheridan

*Attorney, Agent, or Firm*—Blair & Brown

[57] ABSTRACT

A hand winch for scaffolds including a pair of cable drums for separately winding a pair of cables used for simultaneously raising one end of a scaffold. A shaft carrying a spur gear is fixed to the winch frame and the cable drums are journalled on the fixed shaft. A planet gear carrier is secured to the cable drums and rotates therewith with one gear of each pair of planet gears meshing with the spur gear. A hand crank is journalled in the frame and on the fixed shaft and carries a member with an internal spur gear thereon which meshes with the other of the pair of planet gears so that the drive provides a 16½ to 1 mechanical advantage.

1 Claim, 10 Drawing Figures

HAND WINCH

BACKGROUND OF THE INVENTION

1. Field of the Invention

The present invention relates to hand winches for scaffolds.

2. Summary of the Invention

The present invention of a scaffold hand winch includes a winch frame in which a fixed shaft is mounted and in which a hand crank is journalled in the frame and journalled on the fixed shaft. A pair of cable drums are journalled on the shaft and have a planet carrier secured thereto. The planet gears are paired with one of the pair being meshed with a spur gear formed as part of the fixed shaft and the other being meshed with an internal spur gear forming a part of the hand crank. Rotation of the hand crank rotates the internal spur gear causing the planet gears to rotate and move about the fixed spur gear to drive the cable drums at greatly reduced speed to that of the hand crank.

The primary object of the invention is to provide a hand winch with sufficient power to raise a relatively heavy scaffold at one end thereof with the inner and outer sides of the scaffold being raised simultaneously.

Other objects and advantages will become apparent in the following specification when considered in light of the attached drawings.

DESCRIPTION OF THE PREFERRED EMBODIMENT

Figure 1:
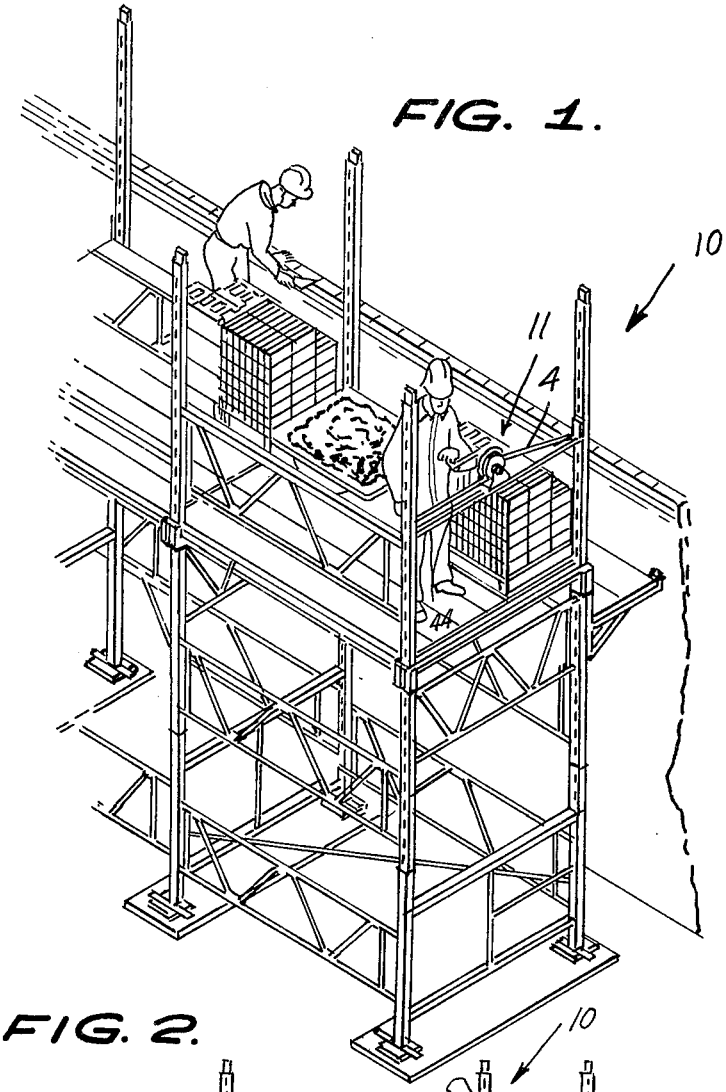
FIG. 1 is a perspective view showing the invention in use on a scaffold.
Figure 2:
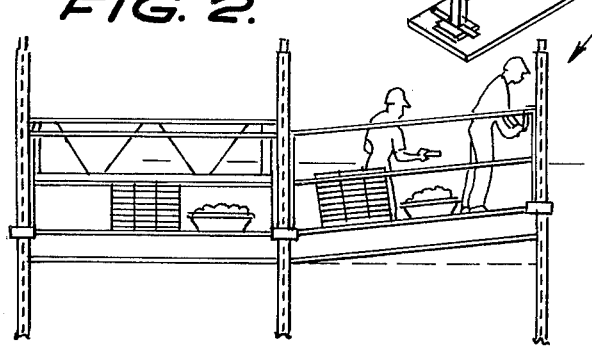
FIG. 2 is a front elevation of the invention in use showing one end of the scaffold being raised.
Figure 3:
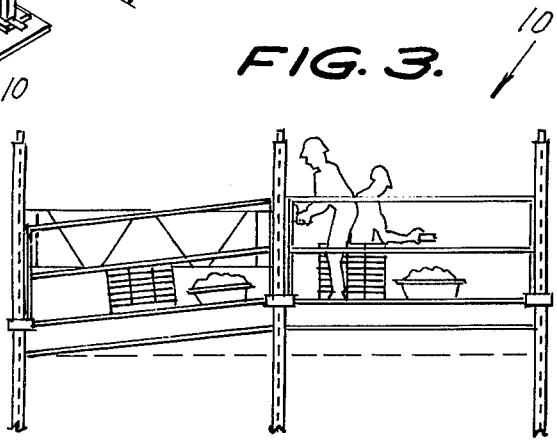
FIG. 3 is a view similar to FIG. 2 with the center portion of the scaffold being raised.
Figure 4:
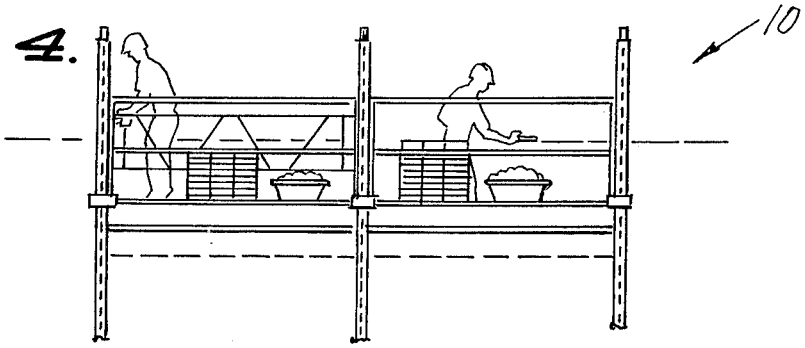
FIG. 4 is a view similar to FIG. 2 with the remaining end of the scaffold being raised.
Figure 5:
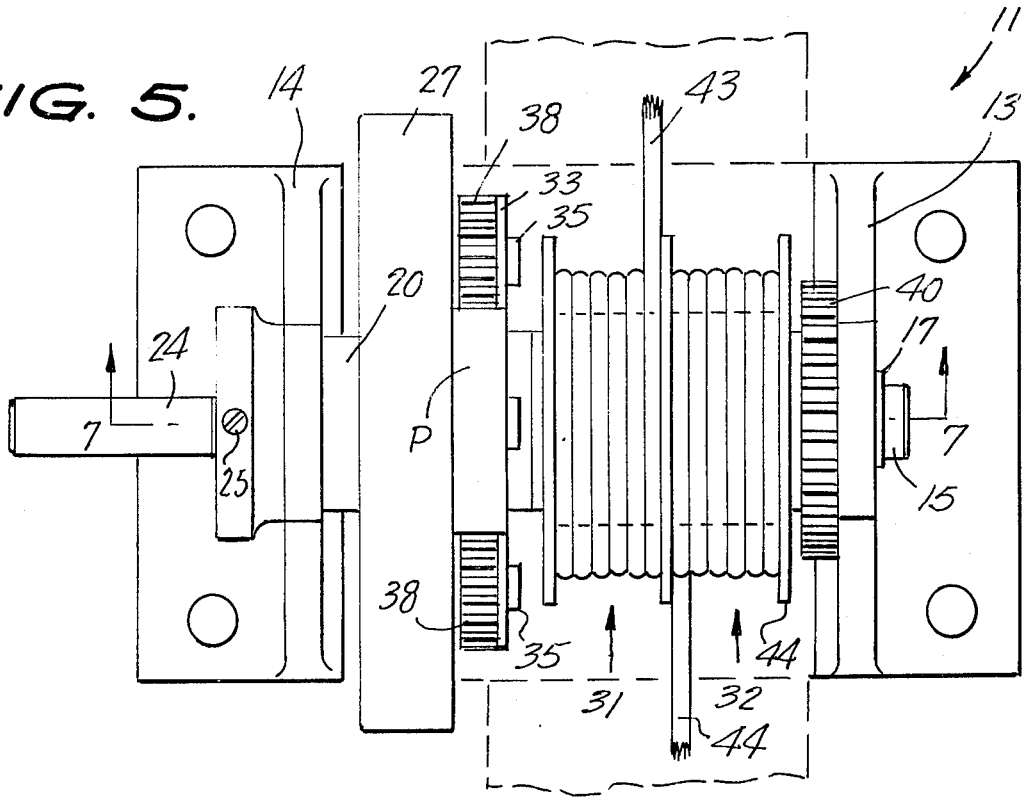
FIG. 5 is a top plan view of the invention.
Figure 6:
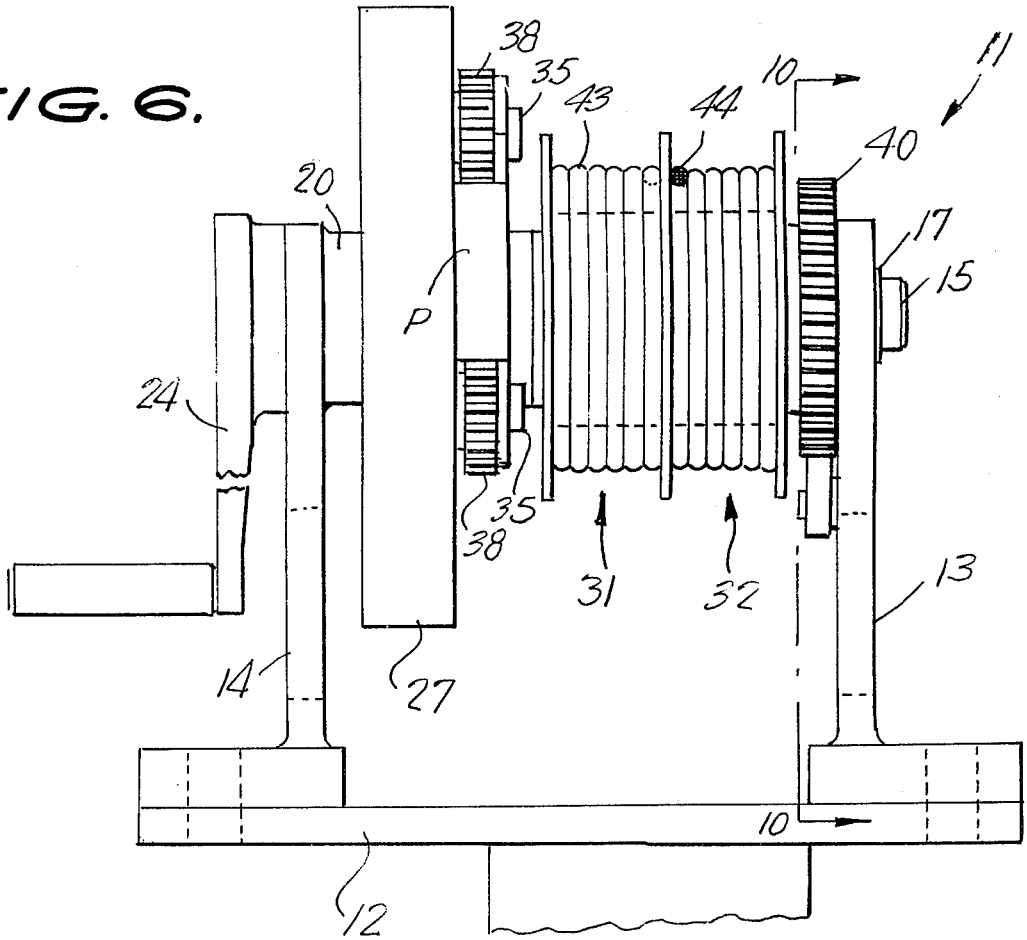
FIG. 6 is a side elevation of the invention.

Referring now to the drawings in detail, wherein like reference characters indicate like parts throughout the several figures, the reference numeral 10 indicates generally a scaffold system incorporating the hand winch indicated generally at 11.

The hand winch 11 includes a base plate 12 having upstanding frame members 13, 14 secured thereto in spaced apart parallel relation. A horizontal shaft 15 is mounted in the frame member 13 and is locked against rotation with respect to the frame member 13 by a key 16 engaging both the frame member and the shaft 15. The shaft 15 is secured to the frame 13 by a snap ring 17.

The fixed shaft 15 has an integral spur gear 18 formed thereon for reasons to be assigned. The shaft 15 has a axial extension 19 projecting outwardly from the spur gear 18.

A shaft 20 is journalled in the frame member 14 on needle bearings 21. An axial counter bore 22 of the shaft 20 extends over the extension 19 and is journalled thereon by needle bearings 23. A hand crank 24 is secured to the shaft 20 by a key 25.

A relatively large diameter disk 26 is integrally formed on the shaft 20 and carries a flange 27 on the perimeter thereof. An internal spur gear 28 is integrally formed with the flange 27 and is spaced from the disk 26 as can be clearly seen in FIG. 7.

Figure 7:
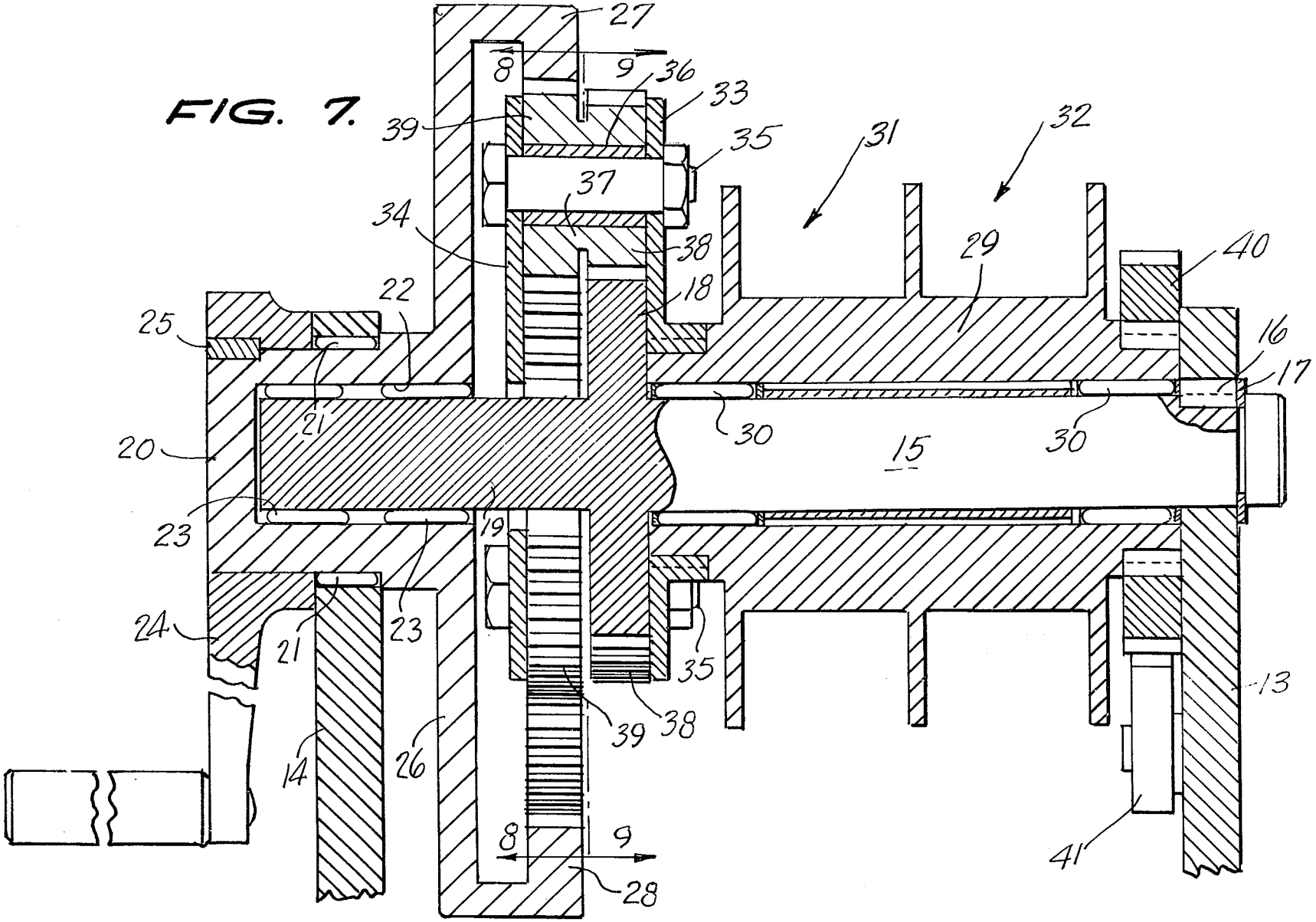
FIG. 7 is an enlarged longitudinal sectional view taken on the line 7—7 of FIG. 5, looking in the direction of the arrows.
Figure 8:
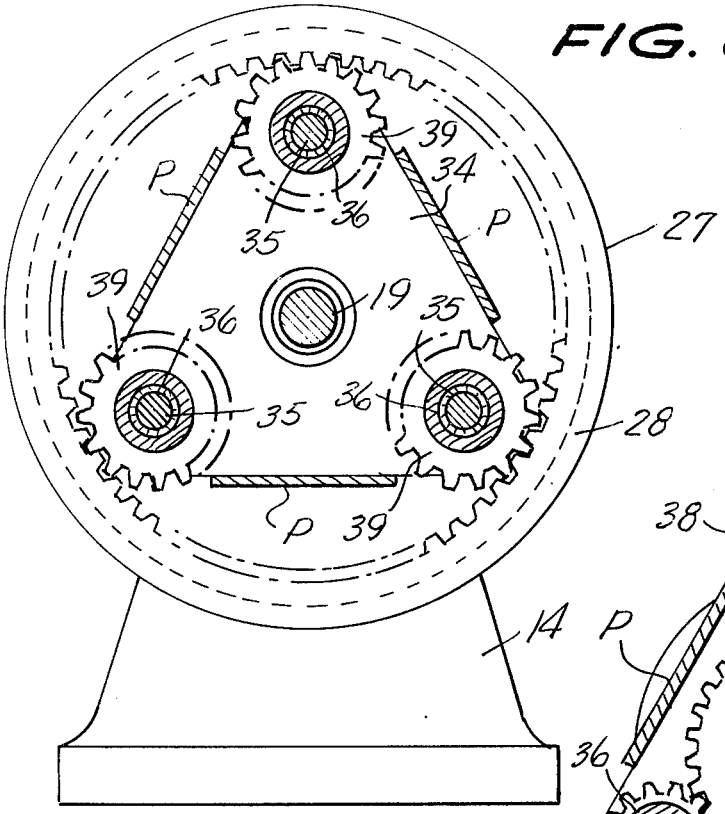
FIG. 8 is a vertical sectional view taken along the line 8—8 of FIG. 7, looking in the direction of the arrows.
Figure 9:
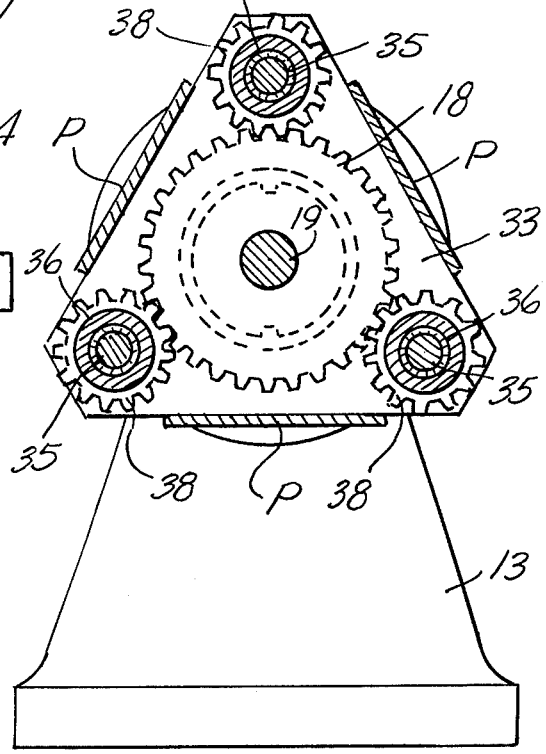
FIG. 9 is a vertical sectional view taken along the line 9—9 of FIG. 7, looking in the direction of the arrows.
Figure 10:
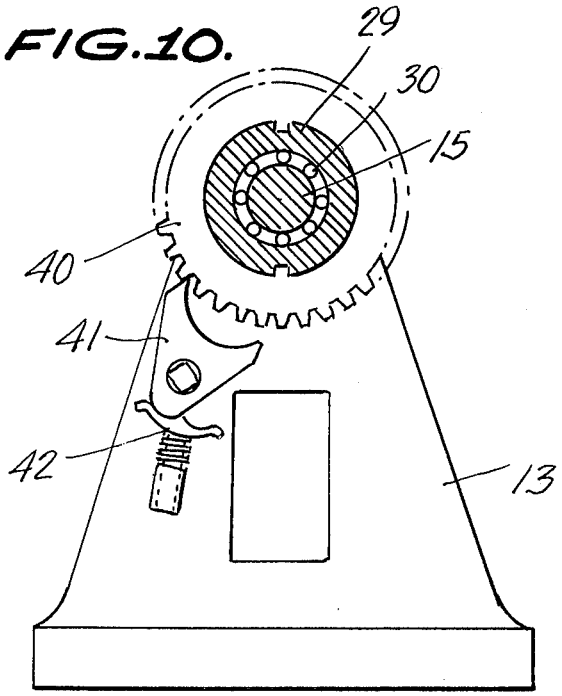
FIG. 10 is a vertical sectional view taken along the line 10—10 of FIG. 6, looking in the direction of the arrows.

A hollow shaft 29 is journalled on the fixed shaft 15 on needle bearings 30 and has a pair of cable drums indicated generally at 31 and 32 integrally formed thereon. A generally triangular carrier plate 33 is fixedly secured to the shaft 29 to rotate therewith. A second generally triangular carrier plate 34 is arranged in spaced parallel relation to the carrier plate 33 as can be seen in FIG. 7. Bolts 35 extend through the carrier plates 33, 34 and have bearing spacers 36 mounted thereon. The bearing spacers 36 engage between the spacer plates 33, 34 and with the bolts 35 maintain the spacer plates 33, 34 in fixed relation. Planet gear members 37 are journalled on the bearing spacer members 36 between the plates 33, 34 and include a spur gear member 38 and a second spur gear member 39 integral with the planet gear member 37. The gear member 38 meshes with the spur gear 18 and the gear members 39 mesh with the internal spur gear 28. Plates P extend between and are welded to the triangular plates 33 and 34 to provide rigidness therebetween.

A spur gear 40 is keyed to the shaft 29 and a double pivoted pawl 41 is engaged therewith to prevent rotation of the shaft 29 in a reverse direction to that desired. An over center spring detent 42 is mounted on the frame 13 to resiliently support the pawl 41 in its locking position.

A cable 43 is wound on the drum 31 and a second cable 44 is wound on the drum 32. The cables 43, 44 are connected to the scaffold 10 in a conventional manner.

In the use and operation of the invention the pawl 41 is set to permit the spur gear 40 to rotate in a desired direction and the hand crank 24 is turned so as to rotate the internal spur gear 28. Rotation of the internal spur gear 28 rotates the planet gear member 37 through the gear member 39 causing the gear member 38 to rotate about the fixed spur gear 18 to thus drive the carrier plates 33, 34 and rotate the cable drums 31, 32. The gear ratios between the internal spur gear 28 and the planet gears 37 rotating on the fixed spur gear 18 are such that 16½ revolutions of the shaft 20 cause one revolution of the shaft 29.

Having thus described the preferred embodiment of the invention it should be understood that numerous structural modifications and adaptations may be resorted to without departing from the spirit of the invention.

What is claimed is:

1. A hand winch comprising a base plate, a pair of spaced apart parallel upright frame members secured to said base plate, a generally horizontal shaft fixedly secured to one of said frame members and extending through a bore in the other of said frame members, a second shaft axial to said first shaft and journalled in the bore in the other of said frame members and journalled on said fixed shaft, a hand crank fixedly secured to said second shaft for rotating said second shaft, a pair of cable drums mounted for rotation on said fixed shaft, planet gear means coupling said second shaft and said cable drums to rotate said cable drums upon rotation of said second shaft at a speed substantially less than the speed of rotation of said second shaft, and means on said cable drums cooperating with means on said one of said frame members for locking said cable drums against rotation in a pre-selected direction.

* * * * *